US007051492B2

(12) United States Patent
Huson

(10) Patent No.: US 7,051,492 B2
(45) Date of Patent: May 30, 2006

(54) FILM WRAPPING APPARATUS WITH NEGATOR SPRING BIASING MEMBERS

(75) Inventor: Gale W. Huson, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 257 days.

(21) Appl. No.: 10/734,277

(22) Filed: Dec. 15, 2003

(65) Prior Publication Data

US 2005/0198922 A1 Sep. 15, 2005

(51) Int. Cl.
*B65B 13/04* (2006.01)

(52) U.S. Cl. ..... 53/399; 53/390; 53/588; 53/392

(58) Field of Classification Search ..... 53/390, 53/592, 588, 587
See application file for complete search history.

(56) References Cited

U.S. PATENT DOCUMENTS

| | | | | |
|---|---|---|---|---|
| 4,067,174 | A | 1/1978 | Goldstein | |
| 4,095,395 | A | 6/1978 | Goldstein | |
| 4,152,879 | A * | 5/1979 | Shulman | 53/399 |
| 4,209,961 | A * | 7/1980 | Donnelley | 53/588 |
| 4,369,614 | A | 1/1983 | Tetzner | |
| 4,409,776 | A | 10/1983 | Usui | |
| 4,745,726 | A | 5/1988 | Rosenthal et al. | |
| 4,756,143 | A | 7/1988 | Lancaster | |
| 4,938,008 | A | 7/1990 | Salzsauler | |
| 5,296,079 | A | 3/1994 | Romo | |
| 5,398,884 | A | 3/1995 | Stanford | |
| 5,423,163 | A | 6/1995 | Wendt | |
| 5,458,841 | A | 10/1995 | Shirrell | |
| 5,561,971 | A | 10/1996 | Sampson | |
| 5,673,542 | A | 10/1997 | Vartanian et al. | |
| 5,779,179 | A | 7/1998 | Zentmyer et al. | |
| 5,941,049 | A | 8/1999 | Lancaster, III et al. | |
| 6,170,233 | B1 | 1/2001 | Marois et al. | |
| 6,237,307 | B1 | 5/2001 | Zentmyer et al. | |
| 6,449,928 | B1 | 9/2002 | Huson | |
| 6,470,657 | B1 | 10/2002 | Huson et al. | |
| 6,526,734 | B1 | 3/2003 | Huson et al. | |
| 6,742,322 | B1 * | 6/2004 | Qicang | 53/588 |

* cited by examiner

*Primary Examiner*—John Sipos
(74) *Attorney, Agent, or Firm*—Schwartz & Weinrieb

(57) ABSTRACT

A portable plastic film wrapping system comprises a push-cart having a vertical mast member mounted thereon, and a film roll carriage is vertically movable along the mast member. The film roll carriage is operatively connected to negator spring members by a film roll carriage lift cable, and a holding pawl mechanism is adapted to be movable between ENGAGED and DISENGAGED positions with respect to the film roll carriage lift cable. When the holding pawl mechanism is moved to its DISENGAGED position, the negator spring members cause the film roll carriage to be vertically elevated, whereas when the holding pawl mechanism is disposed at its ENGAGED position, movement of the film roll carriage lift cable, and the film roll carriage, is effectively prevented. The film roll carriage can also be controllably moved in both upward and downward directions so as to achieve bottom-to-top, as well as top-to-bottom, wrapping modes of operation upon palletized loads.

22 Claims, 7 Drawing Sheets

FILM WRAPPING APPARATUS WITH NEGATOR SPRING BIASING MEMBERS

FIELD OF THE INVENTION

The present invention relates generally to a plastic film wrapping apparatus or system for wrapping palletized loads or products within plastic wrapping film, and more particularly to a new and improved plastic film wrapping apparatus or system wherein the new and improved plastic film wrapping apparatus or system has incorporated therein a negator spring assembly, as opposed to a conventional counterweight mechanism, for controlling the elevational movements of the film roll carriage assembly of the film wrapping apparatus or system, whereby as a result of effectively eliminating the counterweight mechanism, characteristic of conventional, prior art plastic film wrapping apparatus or systems, and replacing the same with the aforenoted negator spring assembly, the vertical extent or overall height dimension of the vertical mast member, along which the film roll carriage assembly is movable when a film wrapping operation is being performed, may be substantially reduced. In view of such reduced height dimension characteristic of the vertical mast member, adverse moment arms or forces are no longer effectively impressed upon the apparatus or system, thereby permitting or facilitating easily controlled steering of the apparatus or system by means of operator personnel. The reduction in the vertical height dimension, and the effective elimination of the adverse moment arms and forces, likewise permits a reduction in the width dimension of the apparatus or system in view of the fact that the new and improved apparatus or system is substantially more stable. In addition, the use of a negator spring assembly facilitates the uniform vertical movement of the film roll carriage assembly along the vertical mast member which, in turn, facilitates or enables the uniform wrapping of the palletized loads within the plastic wrapping film.

BACKGROUND OF THE INVENTION

Various portable plastic film wrapping apparatus, implements, or devices are of course known in the art. Different types or embodiments of such apparatus, implements, or devices may be found, for example, within U.S. Pat. No. 6,526,734 which issued to Huson et al. on Mar. 4, 2003, and U.S. Pat. No. 6,470,657 which issued to Huson et al. on Oct. 29, 2002, as well as within U.S. Pat. No. 6,237,307 which issued to Zentmyer et al. on May 29, 2001, U.S. Pat. No. 5,458,841 which issued to Shirrell on Oct. 17, 1995, and also U.S. Pat. No. 5,398,884 which issued to Stanford on Mar. 21, 1995. As has been disclosed within the aforenoted U.S. Pat. No. 6,237,307 which issued to Zentmyer et al., approximately fifty percent (50%) of all stretch film that is manufactured is applied to, for example, palletized loads or products by manual means. It is also known in the art that when applying such stretch film to, for example, palletized loads or products, the manner in which such stretch film is manually applied to such loads or products usually comprises either one of two methods or techniques. In accordance with a first one of such manual methods or techniques, as disclosed, for example, within the aforenoted U.S. Pat. No. 5,398,884 which issued to Stanford, the operator respectively inserts four fingers of each hand into each one of two oppositely disposed recessed portions defined within the film core end caps so as to effectively hold or grasp the film roll, and while placing his thumbs upon external surface portions of the film roll, so as to cause a predetermined amount of back tension to effectively be applied to the film whereby the film is effectively stretched as the film is being unrolled or dispensed from the film roll, the operator walks around the palletized load or product.

In accordance with a second one of such manual methods or techniques of applying a stretch film to such palletized loads or products, as disclosed, for example, within the aforenoted U.S. Pat. No. 5,458,841 which issued to Shirrell, and in lieu of directly holding or grasping the film roll, the operator holds or grasps a film roll dispensing or holding device which has a built-in tensioning mechanism. In accordance with either one of the aforenoted methods, modes, or manners in which stretch film is applied manually to the palletized products or loads, several operational drawbacks or disadvantages common to both methods or modes were apparent. Firstly, for example, the film roll, or the film roll and film roll dispensing or holding device, had to be supported by the operator personnel, and yet the film roll and the film roll dispensing or holding device are quite heavy and cumbersome. In addition, in order to fully wrap a palletized load, the operator must bend down while holding the film roll, or the film roll and film roll dispensing or holding device, in order to wrap the film around the lower extremity portions of the palletized loads or products. Such requirements upon the operator personnel have been noted to cause acute discomfort, fatigue, and stress-related injuries. In addition, the operators experience fatigue and discomfort even when the operators are wrapping the upper regions of the palletized loads or products due to the continuous need for supporting the entire weight of the film roll, or the film roll and film roll dispensing or holding device.

A need therefore existed in the art for an apparatus, and for a method of operating the same, for overcoming the various operational disadvantages or drawbacks characteristic of such known PRIOR ART systems as briefly discussed hereinbefore and as disclosed within the aforenoted patents, and this need was substantially met by means of the apparatus or system, and the method of operating the same, which has been disclosed within the aforenoted U.S. Pat. No. 6,237,307 which issued to Zentmyer et al. and which has been quite commercially successful. However, while it has been noted within the aforenoted U.S. Pat. No. 6,237,307 which issued to Zentmyer et al. that the disclosed apparatus or system is portable in that the same is mounted upon a platform which has wheels, rollers, or the like so as to render the same movable or mobile, the apparatus is nevertheless relatively large and not readily transportable so as to, in turn, not be readily or easily movable within a particular wrapping plant or facility, or even yet further, readily or easily transportable between different wrapping plants or facilities located at different production sites. Accordingly, the film wrapping apparatus or system, as disclosed within the aforenoted U.S. Pat. No. 6,470,657, which issued to Huson et al., sought to overcome the various operational disadvantages of the known PRIOR ART and in fact successfully did so. More particularly, as disclosed within the aforenoted U.S. Pat. No. 6,470,657 which issued to Huson et al., it is noted that the film wrapping apparatus or system comprises a truly portable apparatus or system which is effectively mounted upon a movable, wheeled platform which is structurally similar to a portable lawnmower.

It was subsequently determined, however, that further improvements to such an apparatus or system were deemed necessary in order to render such apparatus or system simpler in structure. For example, it is noted that in accordance with the teachings and principles embodied within the apparatus or system as disclosed within U.S. Pat. No. 6,470,657 which issued to Huson et al., a clutch drive mechanism was employed in order to control the elevational disposition of the film roll carriage along the vertical mast member. Such a clutch drive mechanism, however, is relatively complex and costly to incorporate within a portable film wrapping apparatus or system. Accordingly, such further improvements were in fact developed whereby, for example, the clutch drive mechanism could effectively be eliminated. More particularly, as disclosed within the aforenoted U.S. Pat. No. 6,526,734 which issued to Huson et al., a counterweight mechanism was operatively incorporated within the apparatus or system so as to effectively and simply control the elevational disposition of the film roll carriage. While the apparatus or system as disclosed within the aforenoted U.S. Pat. No. 6,526,734 which issued to Huson et al. has operated quite satisfactorily, it has been determined still further, however, that additional improvements might optimally be incorporated within such a system in order to render the same essentially smaller in size and easier to operate and control. For example, it is noted that as a result of physically incorporating the counterweight mechanism within the vertical mast member of the apparatus or system, the vertical height or extent of the vertical mast member is substantial.

This vertical height or dimension of the vertical mast member may sometimes present maneuverability and control problems for the operator personnel, in connection with the performance of the wrapping operations as determined by means of the repetitive steering of the portable wrapping apparatus or system around the palletized load, particularly when the counterweight mechanism is disposed within the vicinity of the upper end portion of the vertical mast member. The reason for this is that as a result of the remote disposition or location of the counterweight with respect to the base or platform of the apparatus or system, substantial moment forces or moment arms, as considered in connection with the center of gravity of the apparatus or system, are often adversely impressed upon the apparatus or system. Accordingly, the conventional apparatus or system must have a more extensive width dimension in order to provide the apparatus or system with enhanced stability. In addition, it is noted that in view of the counterweight being obviously influenced by gravitational forces, the counterweight will tend to accelerate and thereby attain different descending rates of speed per foot of vertical elevation whereby, unless the downward movements of the counterweight are precisely controlled, the film wrapping is not necessarily applied to the palletized load in a uniform manner throughout the entire vertical extent or height dimension of the palletized load. Still further, substantial shock-absorbing means must necessarily be incorporated within the lower end portion of the vertical mast member so as to effectively reduce noise, as well as potential structural damage to the apparatus or system, as a result, for example, of the counterweight sometimes impacting the bottom end portion of the vertical mast structure.

A need therefore exists in the art for a new and improved film wrapping apparatus or system, for wrapping palletized loads or products within plastic wrapping film, wherein the apparatus or system is portable, wherein the apparatus or system is relatively simple in structure, wherein the apparatus or system embodies or incorporates structure therewithin which enables both the vertical height and lateral width dimensions to be substantially reduced, and wherein the apparatus or system embodies or incorporates therewithin structure which readily enables or facilitates the manual control of the apparatus or system, the uniform wrapping of the palletized loads or products within the plastic wrapping film, and an enhanced degree of safety for operator personnel.

OBJECTS OF THE INVENTION

Accordingly, it is an object of the present invention to provide a new and improved portable plastic film wrapping apparatus or system for applying wrapping or packaging film to palletized loads or products.

Another object of the present invention is to provide a new and improved portable plastic film wrapping apparatus or system for applying wrapping or packaging film to palletized loads or products wherein the various operational drawbacks and disadvantages, characteristic of PRIOR ART apparatus, systems, or methods of operating the same, are effectively overcome.

An additional object of the present invention is to provide a new and improved portable plastic film wrapping apparatus or system for applying wrapping or packaging film to palletized loads or products wherein as a result of the vertical movements of the film roll carriage of the film wrapping apparatus or system, along the vertical mast member, no longer being controlled by means of a counterweight mechanism but, to the contrary, being controlled by means of a negator spring assembly, the vertical mast member no longer needs to house or accommodate a counterweight mechanism whereby the height dimension of the vertical mast member can be substantially reduced.

A further object of the present invention is to provide a new and improved portable plastic film wrapping apparatus or system for applying wrapping or packaging film to palletized loads or products wherein as a result of the vertical movements of the film roll carriage of the film wrapping apparatus or system, along the vertical mast member, no longer being controlled by means of a counterweight mechanism but, to the contrary, being controlled by means of a negator spring assembly, the vertical mast member no longer needs to house or accommodate a counterweight mechanism whereby the height dimension of the vertical mast member can be substantially reduced such that destabilizing moment arms or forces are effectively eliminated so as to permit operator personnel to easily control the film wrapping apparatus or system during the film wrapping or packaging operation, and wherein, further, the width dimension of the apparatus or system can likewise be substantially reduced in view of the fact that the destabilizing moment arms or forces have been eliminated.

A last object of the present invention is to provide a new and improved portable plastic film wrapping apparatus or system for applying wrapping or packaging film to palletized loads or products wherein as a result of the vertical movements of the film roll carriage of the film wrapping apparatus or system, along the vertical mast member, no longer being controlled by means of a counterweight mechanism but, to the contrary, being controlled by means of a negator spring assembly, the vertical movements of the film roll carriage are not subjected to accelerated movements which would otherwise result in variable speeds of descent, and in addition, vertically movements of the film roll carriage may be achieved in an infinitely controlled manner.

SUMMARY OF THE INVENTION

The foregoing and other objectives are achieved in accordance with the teachings and principles of the present invention through the provision of a new and improved portable film wrapping apparatus or system, for applying packaging or wrapping film to palletized loads or products disposed at a wrapping station or location, which comprises a manually movable cart which includes a chassis or framework having a pair of relatively large, non-pivotal, or non-caster type, wheels mounted upon a rear end portion of the chassis or framework, while a pair of relatively small, pivotal, or caster-type wheels, are mounted upon a front end portion of the chassis or framework so as to permit the cart to be easily steered. A vertically oriented mast member extends upwardly from the chassis or framework, and a film roll carriage, upon which a roll of plastic wrapping film is rotatably disposed so as to be capable of having plastic wrapping film dispensed therefrom, is movably mounted upon the vertically oriented mast member. The film roll carriage is operatively connected, by means of a lift cable, to a negator spring assembly which comprises a pair of negator springs mounted upon the chassis or framework, and a pawl mechanism, operatively connected to an operator control handle by means of a suitable control cable, is adapted to be releasably engaged with the lift cable. Accordingly, at the beginning of a plastic film wrapping operation, the film roll carriage is moved to its lowermost position thereby, in effect, uncoiling the pair of negator springs, and the film roll carriage is maintained at such position, as well as at any other particularly desired elevational position, as a result of the pawl mechanism being engaged with the lift cable. When the operator begins to wrap the particular palletized load within the plastic wrapping film, as a result of the operator steerably guiding the portable apparatus or system around the palletized load disposed at the film wrapping station, the operator can release the pawl mechanism, for any desired period of time, from its engaged position with the lift cable whereby the pair of negator springs will tend to recoil back to their normally coiled state thereby causing the film roll carriage to be lifted or elevated so as to move along the vertically oriented mast member.

Accordingly, if continuous spiral wrapping of the palletized load or product is desired to be achieved while the operator walks, and simultaneously steers the apparatus or system, around the palletized load disposed at the wrapping station, the operator simply needs to actuate the control cable so as to effectively cause the pawl mechanism to be released from its engaged position with respect to the lift cable whereby the recoiling of the pair of negator springs will serve to elevate the film roll carriage at a constant rate of speed such that uniform wrapping of the palletized load or product within the packaging or wrapping film is able to be achieved. Alternatively, if continuous concentric wrapping of the palletized load or product within the packaging or wrapping film at a particular elevational level is desired, which is known as reinforcing wrapping, the control cable is not actuated whereby the pawl mechanism is maintained engaged with the lift cable such that further elevation of the film roll carriage, and the roll of wrapping film mounted thereon, is effectively prevented. At the completion of a wrapping cycle or operation, the operator can use either one of two alternative means for moving the film roll carriage in a downward mode from its elevated position, back toward its lowered START position, which effectively disengages the pawl mechanism from the lift cable and simultaneously causes the pair of negator springs to again be uncoiled in preparation for a subsequent palletized load or product film packaging or wrapping operation or cycle. The apparatus or system of the present invention also permits several operative components thereof to effectively be reversed whereby in lieu of the film roll carriage being elevated during a film-wrapping operation or cycle wherein the palletized load or product is normally wrapped in a direction proceeding upwardly from the bottom of the load or product, the film roll carriage can descend during a film-wrapping operation or cycle wherein the palletized load or product is wrapped in a direction proceeding downwardly from the top of the load or product.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
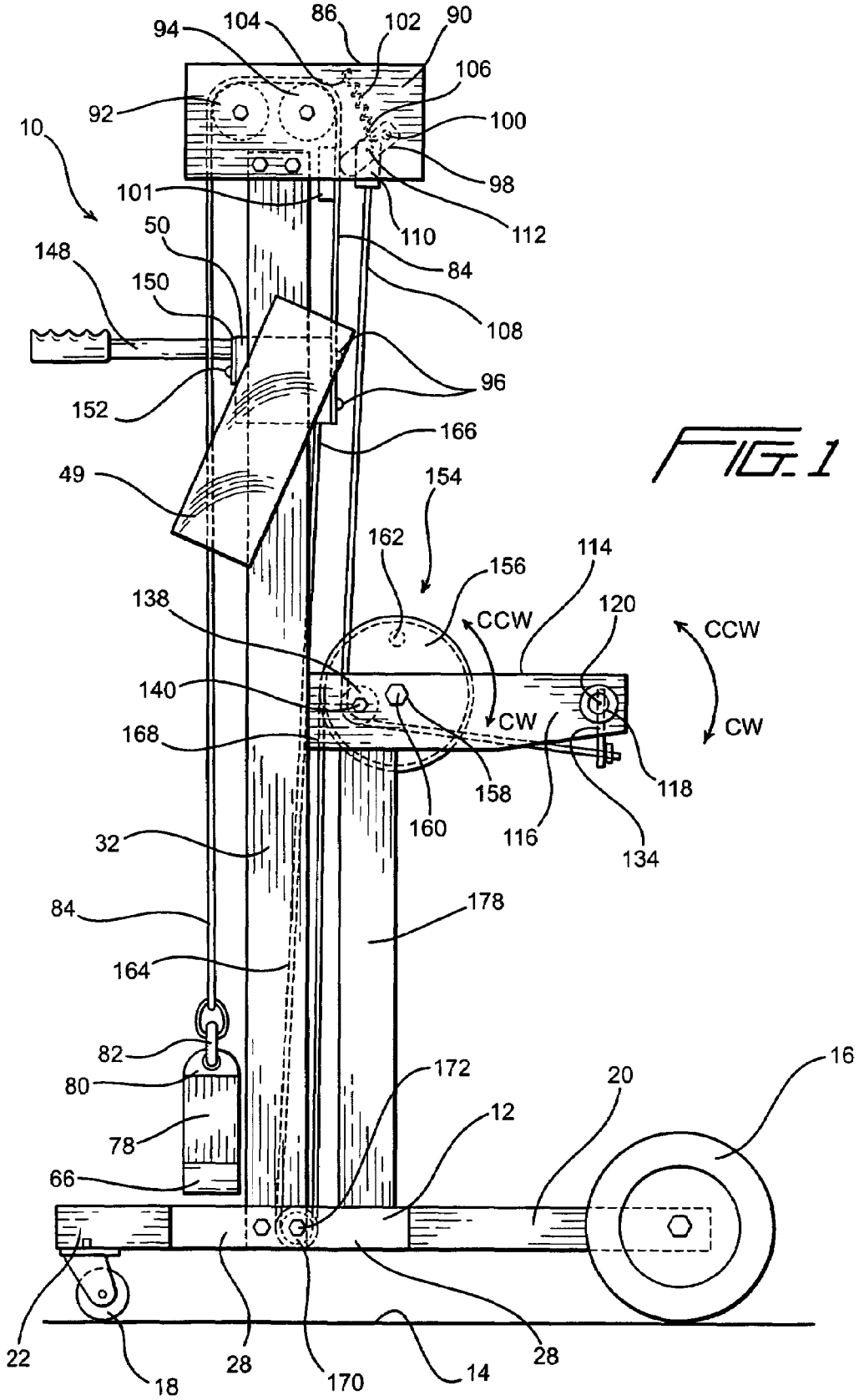
FIG. 1 is a side elevational view of a first embodiment of a new and improved portable plastic film wrapping apparatus or system which has been constructed in accordance with the principles and teachings of the present invention and which shows the new and improved cooperative parts thereof, for use in connection with the wrapping of palletized loads or products within plastic wrapping film, particularly the use of the negator spring-lift cable assembly and the holding pawl control mechanism operatively associated therewith for controlling the elevational movement of the film roll carriage.

Referring now to the drawings, and more particularly to FIGS. 1,2,6, and 7 thereof, a first embodiment of a new and improved palletized load plastic film wrapping apparatus or system, constructed in accordance with the teachings and principles of the present invention, is disclosed and is generally indicated by the reference character 10. The apparatus or system 10 is mounted upon a movable cart which renders the entire apparatus or system 10 portable and transportable, and it is seen that the movable cart comprises a chassis or framework 12 which is adapted to be rollably supported and moved along a floor or ground region 14 by means of a pair of laterally or transversely spaced, non-pivotal rear wheels 16,16, and a pair of laterally or transversely spaced, pivotal or steerable front caster wheel assemblies 18, 18. In this manner, the entire palletized load plastic film wrapping apparatus or system 10 can be easily moved and steered around a suitable workstation at which the palletized load is disposed when undergoing a wrapping or packaging operation or procedure. As can best be appreciated from FIG. 6, the chassis or framework 12 substantially comprises two chassis or framework sections which are adapted to be bolted or otherwise fixedly connected together, as will be discussed shortly hereafter, wherein, for example, the left chassis or framework section comprises a rear chassis or framework portion 20 upon which the left rear wheel 16 is rotatably mounted, and a front chassis or framework portion 22 upon which the left front caster wheel assembly 18 is pivotally mounted.

In a similar manner, the right chassis or framework section comprises a rear chassis or framework portion 24 upon which the right rear wheel 16 is rotatably mounted, and a front chassis or framework portion 26 upon which the right front caster wheel assembly 18 is pivotally mounted. The left and right chassis or framework sections further comprise left and right intermediate chassis or framework portions 28,30 which respectively integrally interconnect the left rear and left front framework or chassis portions 20,22, and the right rear and right front chassis or framework portions 24,26, to each other, and it is further seen that the left and right intermediate chassis or framework portions 28,30 are disposed parallel to each other in a laterally or transversely spaced manner. In this manner, the lower end portion of a vertically oriented mast member 32 is able to be interposed between the left and right intermediate chassis or framework portions 28,30, and in addition, all three structural components, comprising the left and right intermediate chassis or framework portions 28,30 and the lower end portion of the vertically oriented mast member 32, can then be bolted or otherwise fixedly secured together.

Figure 2:
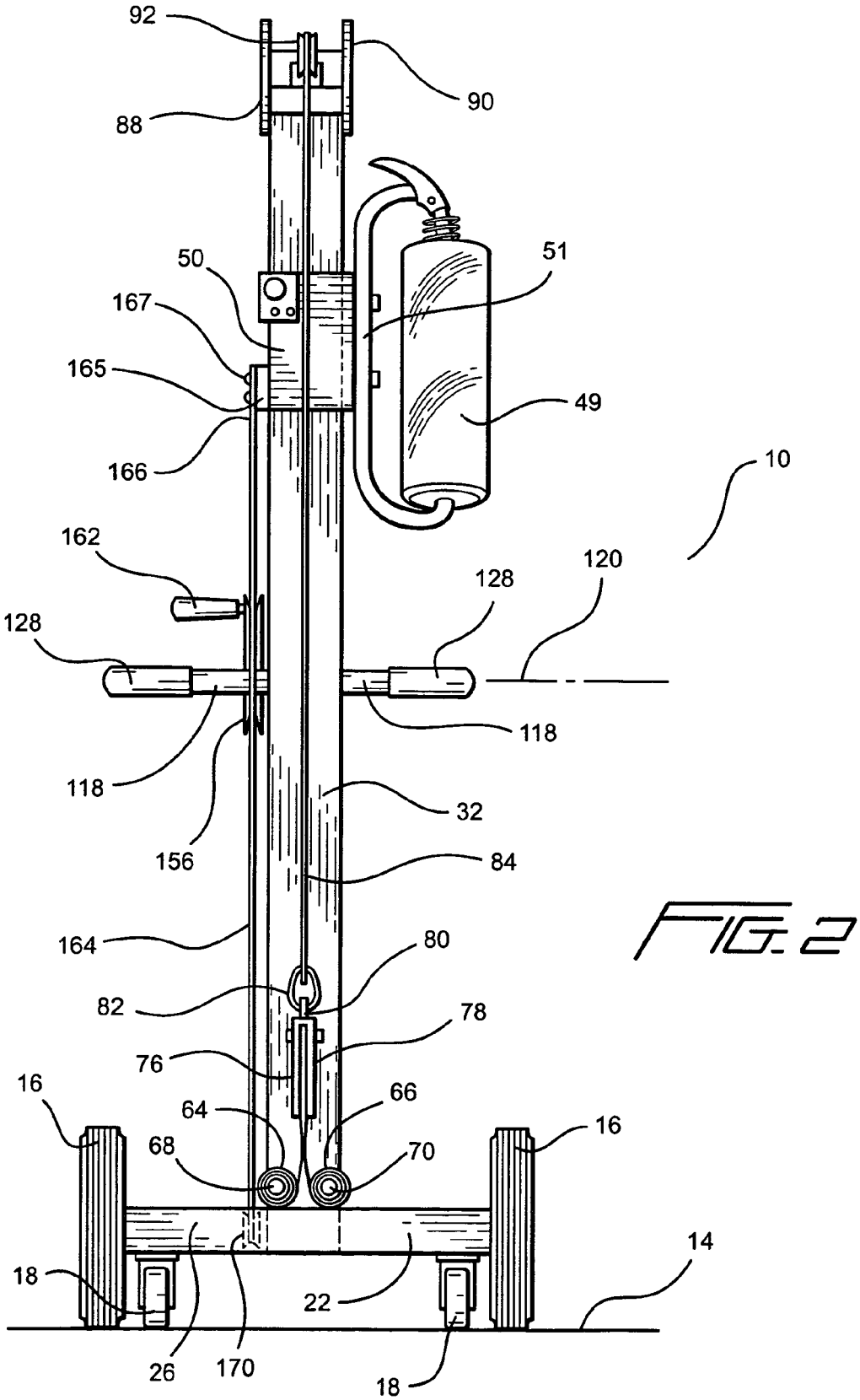
FIG. 2 is a front elevational view of the new and improved portable plastic film wrapping apparatus or system as illustrated within FIG. 1 and showing, in particular, the mounting of the pair of negator springs upon the chassis or framework of the apparatus or system and their operative connection to the lift cable so as to control the elevational movement of the film roll carriage.
Figure 3:
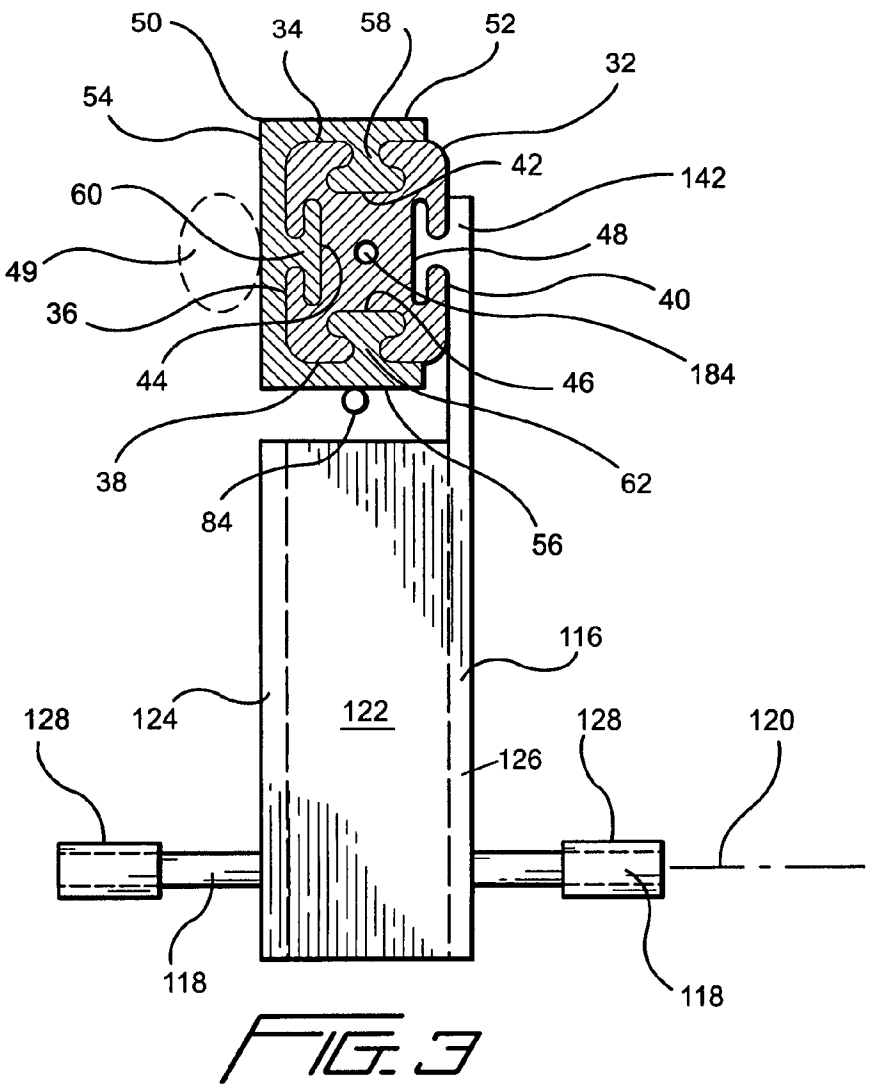
FIG. 3 is a cross-sectional view of the vertically oriented mast member-film roll carriage assembly showing the details of the slidable mounting of the film roll carriage upon the vertically oriented mast member.
Figure 5:
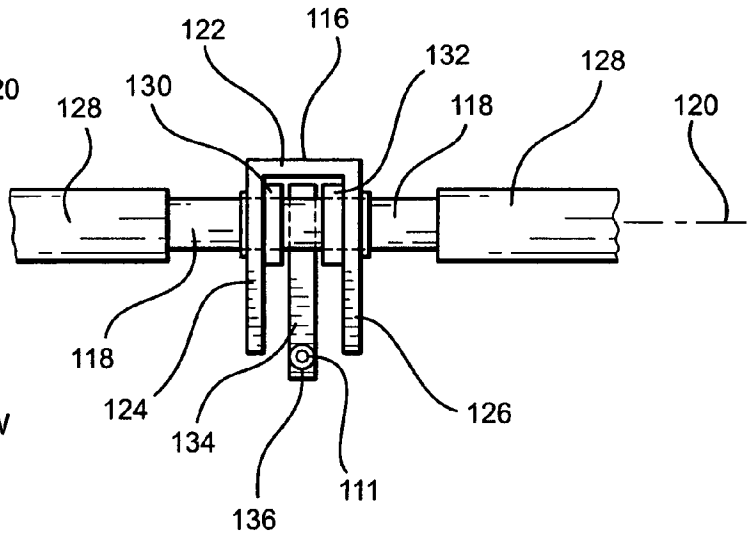
FIG. 5 is an enlarged end elevational view, corresponding to FIG. 4, showing the mounting of the operator control handles within the mounting bracket assembly fixedly mounted upon the vertically oriented mast member and as operatively connected to the control lever for the control cable.

As can best be appreciated from FIG. 3, the vertically oriented mast member 32 comprises an aluminum extrusion in the form of a rectangular parallelepiped wherein the same has a rectangular cross-sectional configuration. More particularly, it is seen that the vertically oriented mast member 32 has four side surfaces 34,36,38,40, and each one of the four side surfaces 34,36,38,40 is provided with an inwardly extending, vertically oriented mortise-shaped recess 42,44, 46,48. A film roll carriage 50, having a roll of wrapping or packaging film 49 mounted thereon by means of a suitable film roll holder and mounting bracket assembly 51, as best seen in FIG. 2, is adapted to be slidably mounted upon the vertically oriented mast member 32. In particular, the film roll carriage 50 has a substantially C-shaped cross-sectional configuration and accordingly comprises three side surfaces 52,54,56. Each one of the three side surfaces 52,54,56 of the film roll carriage 50 is provided with an inwardly extending tenon 58,60,62 which has a configuration which matches or corresponds to the configuration of a respective one of the mortise-shaped recesses 42,44,46, so as to be respectively slidably disposed within each one of the mortise-shaped recesses 42,44,46. In this manner, the inwardly extending tenons 58,60,62, together with the mortise-shaped recesses 42,44,46, define dovetail joint assemblies by means of which the film roll carriage 50 is securely, yet movably or slidably, disposed or mounted upon the vertically oriented mast member 32.

In order to control the vertical, slidable movements of the film roll carriage 50 along the vertically oriented mast member 32, and in accordance with the new and improved, unique and novel system characteristic of the present invention, the film roll carriage 50 is adapted to be operatively connected to a pair of negator spring members 64,66 which can be seen in FIGS. 1,2,6, and 7. More particularly, each one of the negator spring members 64,66 is coiled around a spool or core member 68,70, and as can best be seen from FIG. 6, the spools or core members 68,70 are rotatably mounted within suitable mounting bracket assemblies, only one of which is illustrated at 72. The mounting bracket assemblies 72 are fixedly mounted upon a mounting block 74 which, in turn, is fixedly mounted or secured between the laterally or transversely spaced left and right intermediate chassis or framework portions 28,30. Free end portions of the negator spring members 64,66 are adapted to be fixedly secured between a pair of clamping plates 76,78, and the pair of clamping plates 76,78 have a suspension bracket 80 integrally connected thereto. A portion of an eye-hook 82 is passed through the suspension bracket 80, and a film roll carriage lift cable 84 has a first lower end portion thereof secured within the eye-hook 82. A pulley housing 86, comprising a pair of oppositely disposed mounting plates 88,90 which are bolted or otherwise fastened to the upper end portion of the vertically oriented mast member 32, has a pair of pulleys 92,94 rotatably mounted therein. Accordingly, the film roll carriage lift cable 84 extends upwardly from the lower end portion thereof which is secured within the eye-hook 82 and which is effectively connected to the negator spring members 64,66, the film roll carriage lift cable 84 is routed around the pair of pulleys 92,94, and the free end portion of the film roll carriage lift cable 84 is fixedly attached to the rear side surface 56 of the film roll carriage 50 by means of suitable fasteners 96, as can best be appreciated from FIGS. 1 and 3.

As has been noted hereinbefore, in order to control the vertical, slidable movements of the film roll carriage 50 along the vertically oriented mast member 32, in accordance with the unique and novel structural arrangement characteristic of the new and improved palletized load film wrapping or packaging system or apparatus of the present invention, the film roll carriage 50 has been disclosed as being operatively connected to the pair of negator spring members 64,66, and in addition, the negator spring members 64, 66 are effectively connected to the chassis or framework 12. Consequently, when the film roll carriage 50 is initially moved to and disposed at, for example, its lowermost START position along the vertically oriented mast member 32 in preparation for the commencement of a film wrapping or packaging operation or procedure, it can be appreciated that the lift cable 84 will cause the free end portions of the negator spring members 64,66, and the pair of clamping plates 76, 78 fixedly connected thereto, to be correspondingly moved to and disposed at their uppermost positions with respect to the vertically oriented mast member 32 whereby the negator spring members 64,66 will have been extended to their UNCOILED or EXTENDED states from their normal COILED or CONTRACTED states. Accordingly, the negator spring members 64, 66 will constantly tend to return or retract back to their normal COILED states from the noted UNCOILED states whereby the free end portions of the negator spring members 64,66, and the pair of clamping plates 76,78 fixedly connected thereto, will be moved downwardly toward their lowermost positions with respect to the vertically oriented mast member 32, as illustrated, for example, within FIGS. 1,2, 6, and 7. In this manner, the film roll carriage 50, and the roll of wrapping or packaging film 49 mounted thereon, will be caused to move upwardly along the vertically oriented mast member 32 at a substantially constant rate of speed, when the negator spring members 64,66 are in fact permitted to retract or return to their normal COILED states, thereby permitting the palletized load to be wrapped or packaged within the wrapping or packaging film from the lower end portion of the palletized load to the upper end portion of the palletized load as the apparatus or system 10 of the present invention is moved around the workstation at which the palletized load is located.

Continuing further, then, and with reference being particularly made to FIGS. 1 and 3–5, in order to effectively control the retractive, coiling movements of the negator spring members 64,66, and the corresponding vertically upward movement of the film roll carriage 50, and the roll of wrapping or packaging film mounted thereon, along the vertically oriented mast member 32, a holding pawl mechanism or member 98 is pivotally mounted within the pulley housing 86 upon a suitable pivot pin 100, and a support block 101 is fixedly mounted within the pulley housing 86 between the pair of oppositely disposed mounting plates 88,90 so as to operatively cooperate with the holding pawl mechanism or member 98. A tensioning spring 102 has a first end portion 104 thereof fixedly connected to at least one of the mounting plates 88,90 of the pulley housing 86, while a second opposite end portion 106 of the tensioning spring 102 is fixedly connected to the holding pawl mechanism or member 98. In this manner, as can be readily appreciated from FIG. 1, due to the pivotal mounting of the holding pawl mechanism or member 98 upon the pulley housing 86, and the connection of the tensioning spring 102 to the holding pawl mechanism or member 98, the tensioning spring 102 will tend to always bias the holding pawl mechanism or member 98 toward a predetermined angular orientation or disposition with respect to the film roll carriage lift cable 84 such that the holding pawl mechanism or member 98 is normally disposed in engaged contact with that portion of the film roll carriage lift cable 84 which is interposed between the film roll carriage 50 and the lift cable pulley 94 and which is also in fact disposed within the immediate vicinity of the lift cable pulley 94.

Accordingly, when the holding pawl mechanism or member 98 is in fact disposed at its ENGAGED contact position with respect to the film roll carriage lift cable 84, vertical movement of the film roll carriage 50, and the roll of wrapping or packaging film mounted thereon, along the vertically oriented mast member 32 is effectively prevented as a result of that portion of the film roll carriage lift cable 84 effectively being trapped between the holding pawl mechanism or member 98 and the support block 101, whereas, conversely, when the pawl mechanism or member 98 is in fact disposed at a position at which the pawl mechanism or member 98 is DISENGAGED from the film roll carriage lift cable 84, vertical movement of the film roll carriage 50, and the roll of wrapping or packaging film mounted thereon, along the vertically oriented mast member 32 is permitted as a result of that portion of the film roll carriage lift cable 84 being effectively able to move freely along the support block 101.

In order to in fact control the disposition of the holding pawl mechanism or member 98 between its ENGAGED and DISENGAGED states or positions with respect to the film roll carriage lift cable 84 and the support block 101, a holding pawl release cable 108 has a first end portion 107 thereof operatively connected to the holding pawl mechanism or member 98 through means of a yoke member 110 and a first cable clamp member 109, while a second opposite end portion 111 of the holding pawl release cable 108 is fixedly connected to an operator push-bar assembly 114, wherein the push-bar assembly 114 also serves as the means by which the operator controls and steers the new and improved palletized load film wrapping or packaging apparatus or system 10 during movement of the same around the palletized load disposed at the film wrapping or packaging workstation. It is noted that the yoke member 110 is pivotally connected to the holding pawl mechanism or member 98 at a position 112 which is disposed upon the same side of the pivot axis 100 of the holding pawl mechanism or member 98, and in this manner, the actuating forces to be impressed upon the holding pawl mechanism or member 98 by means of the holding pawl release cable 108, as transmitted through means of the yoke member 110, can effectively counteract and overcome the biasing. force of the tensioning spring 102.

Accordingly, when the operator actuates the appropriate operative components disposed within the push-bar assembly 114, the holding pawl release cable 108 will be actuated whereby, acting through means of the yoke member 110, the holding pawl release cable 108 will cause the holding pawl mechanism or member 98 to be actuated or moved, against the biasing force of the tensioning spring 102, from its ENGAGED position, with respect to the film roll carriage lift cable 84 and the support block 101, to its DISENGAGED position with respect to the film roll carriage lift cable 84 and the support block 101. Conversely, when the operator deactuates the appropriate operative components disposed within the push-bar assembly 114, or permits the appropriate operative components disposed within the push-bar assembly 114 to return to their original or normal, non-actuated positions, the tensioning spring 102 will cause the holding pawl mechanism or member 98 to be actuated or moved back to its ENGAGED position with respect to the film roll carriage lift cable 84 and the support block 101.

More particularly, as can be appreciated from FIGS. 1–5, and 7, the operator push-bar assembly 114 is seen to comprise a push-bar assembly housing 116 within which a pair of oppositely extending push-bars or control handles 118,118, which are integrally connected to each other upon a common shaft, are mounted so as to be pivotal or rotatable around a transversely extending axis 120. As can best be appreciated from FIG. 5, the push-bar assembly housing 116 is seen to comprise a substantially three-sided structure comprising a top wall member 122, and a pair of oppositely disposed, laterally spaced dependent side wall members 124,126, the oppositely extending push-bars or control handles 118,118 projecting respectively outwardly through the side wall members 124,126.

In order to facilitate the pivotal or rotatable actuation movement of the pair of oppositely extending push-bars or control handles 118,118 around the transversely extending axis 120, the laterally outwardly free end portion of each one of the push-bars or control handles 118,118 is respectively provided with a rubber sleeve or grip member 128,128. In order to enable the pair of oppositely extending push-bars or control handles 118,118 to be pivotally or rotatably moved around the transversely extending axis 120, those portions or sections of the push-bars or control handles 118,118 which actually extend or project through the side wall members 124,126 of the push-bar assembly housing 116 are respectively mounted within suitable bushing members 130,132. It is further seen that a vertically dependent release cable actuating lever 134 is fixedly mounted upon a central portion of the common shaft comprising the integrally connected push-bars or control handles 118,118, and in this manner the release cable actuating lever 134 will be pivoted or rotated in conjunction with the pivotal or rotational movements of the push-bars or control handles 118, 118. Still further, it is seen that the second end portion 111 of the holding pawl release cable 108 is fixedly secured to the release cable actuating lever 134 by means of a second cable clamp member 136, while an intermediate portion of the holding pawl release cable 108 is routed around a guide pulley 138 which is rotatably mounted within the push-bar assembly housing 116 by means of a suitable pin, axle, or trunnion 140. In this manner, the directional orientation of the holding pawl release cable 108 can effectively be changed from a substantially vertical orientation, which permits the first end portion 107 of the holding pawl release cable 108 to be operatively connected to the holding pawl yoke member 110, to a substantially horizontal orientation which permits the second end portion 111 of the holding pawl release cable 108 to be operatively connected to the release cable actuating lever 134.

Figure 4:
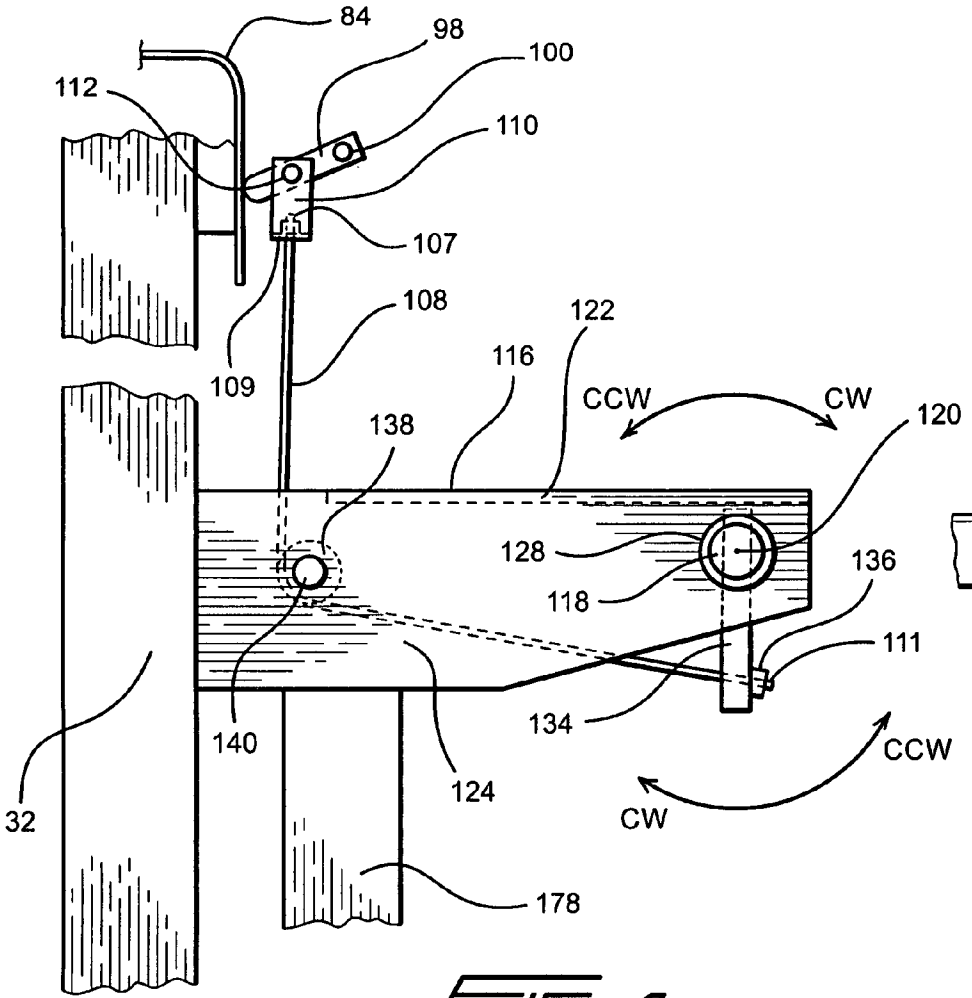
FIG. 4 is an enlarged detail, side elevational view showing the operative connection of the operator control handles, and the control lever, to the control cable, as well as the operative connection of the control cable to the pawl mechanism, so as to permit the operator to control the disposition of the pawl mechanism between its operative ENGAGED and DISENGAGED positions or states with respect to the film roll carriage lift cable.
Figure 6:
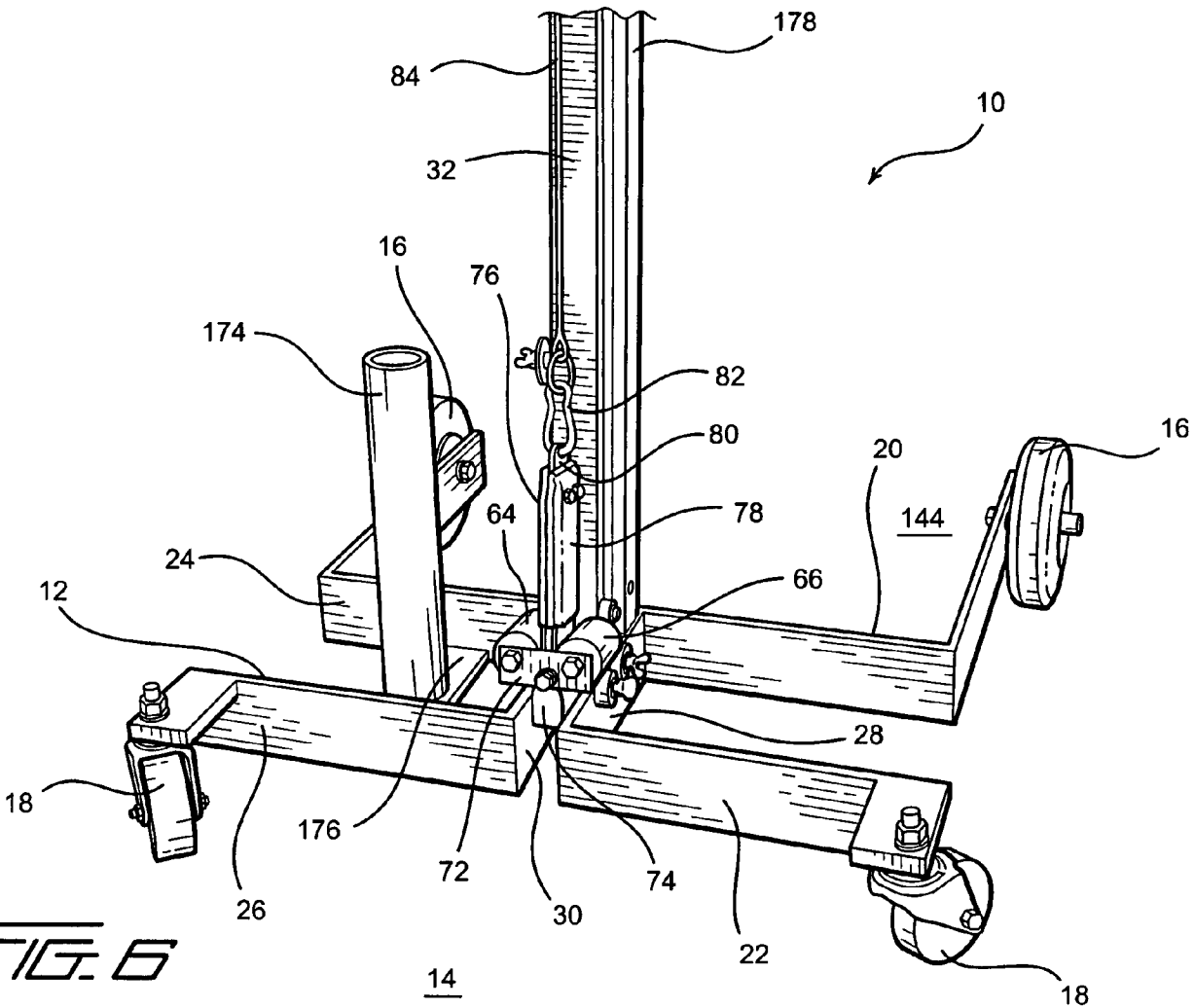
FIG. 6 is a perspective view showing the uniquely configured chassis or framework of the new and improved film wrapping apparatus or system as illustrated within FIGS. 1 and 2.

As may therefore be best appreciated, for example, from FIG. 4, when the push-bars or control handles 118,118 are pivoted or rotated around the transversely extending axis 120 in the counterclockwise direction CCW, the release cable actuating lever 134 will likewise be pivoted or rotated in the counterclockwise direction CCW whereby the second end portion 111 of the holding pawl release cable 108 will effectively be moved toward the right as viewed in FIGS. 1 and 4. Accordingly, such movement of the second end portion 111 of the holding pawl release cable 108 will effectively cause the holding pawl yoke member 110 to be moved vertically downwardly so as to, in turn, cause the holding pawl member of mechanism 98 to be pivotally moved away from its ENGAGED state with respect to the film roll carriage lift cable 84 and the support block 101, to its DISENGAGED state with respect to the film roll carriage lift cable 84 and the support block 101. In this manner, since the first end portion of the film roll carriage lift cable 84, which is interposed between the holding pawl mechanism or member 98 and the support block 101, is no longer effectively trapped between the holding pawl mechanism or member 98 and the support block 101, the negator spring members 64,66, which are operatively connected to the second opposite end portion of the film roll carriage lift cable 84, can recoil thereby causing such second opposite end portion of the film roll carriage lift cable 84 to move vertically downwardly so as to, in turn, cause the first end portion of the film roll carriage lift cable 84 to move vertically upwardly. Accordingly, the film roll carriage 50, and the roll of wrapping or packaging film 49 mounted thereon, is permitted to move vertically upwardly along the vertically oriented mast member 32.

Conversely, when the push-bars or control handles 118, 118 are effectively released or manually moved by the operator so as to be pivoted or rotated around the transversely extending axis 120 in the clockwise direction CW, the release cable actuating lever 134 will likewise be pivoted or rotated in the clockwise direction CW whereby the second end portion 111 of the holding pawl release cable 108 will effectively be moved toward the left, as viewed in FIGS. 1 and 4, under the biasing influence of the tensioning spring 102. Accordingly, such movement of the second end portion 111 of the holding pawl release cable 108 will effectively permit the holding pawl yoke member 110 to be moved vertically upwardly so as to, in turn, cause the holding pawl mechanism or member 98 to be pivotally moved from its DISENGAGED state, with respect to the film roll carriage lift cable 84 and the support block 101, back to its ENGAGED state with respect to the film roll carriage lift cable 84 and the support block 101. In this manner, since the first end portion of the film roll carriage lift cable 84, which is interposed between the holding pawl mechanism or member 98 and the support block 101, is once again effectively trapped between the holding pawl mechanism or member 98 and the support block 101, further vertically upward movement of the first end portion of the film roll carriage lift cable 84, as well as corresponding vertically upward movement of the film roll carriage 50, and the roll of wrapping or packaging film 49 mounted thereon, along the vertically oriented mast member 32, is effectively prevented.

The aforenoted operative cycles, for controlling the vertical movements of the film roll carriage 50, and the roll of wrapping or packaging film 49 mounted thereon, along the vertically oriented mast member 32, can of course be readily performed in a variety of modes so as to achieve particular types of film wrapping or packaging of the palletized loads as may be desired. It is to be further appreciated that in order to permit the operator to comfortably grasp the push-bars or handles 118,118, and thereby easily and readily control the apparatus or system 10 while the operator is steerably moving or maneuvering the apparatus or system 10 around the palletized load disposed at the film wrapping or packaging workstation, the push-bar assembly housing 116 is adapted to be fixedly mounted at a predetermined elevational level upon the vertically oriented mast member 32. More particularly, as can best be appreciated from FIG. 3, the side wall 126 of the push-bar assembly housing 116 has a longitudinal extent or length dimension which is greater than that of the oppositely disposed side wall 124 of the push-bar assembly housing 116 so as to effectively extend beyond the normal confines of the push-bar assembly housing 116 and thereby be disposed or extend along the fourth side surface 40 of the vertically oriented mast member 32. In addition, it is seen that the free or distal end portion of the side wall 126 of the push-bar assembly housing 116 is provided with an inwardly extending tenon 142 which is similar to the aforenoted tenons 58,60,62 integrally and respectively formed upon each one of the three side surfaces 52,54,56 of the film roll carriage 50.

Accordingly, the tenon 142, formed upon the free or distal end portion of the side wall 126 of the push-bar assembly housing 116, is adapted to be adjustably or movably mated within the mortise-shaped recess 48 formed within the fourth side surface 40 of the vertically oriented mast member 32. Bolt fasteners, not shown, may then in fact be subsequently used to complete the fixation of the push-bar assembly housing 116 upon the vertically oriented mast member 32 at the particularly desired elevational level. It is additionally noted that, in conjunction with, or in furtherance of, the aforenoted easily and readily achievable steerability, maneuverability, or control of the apparatus or system 10 around the film wrapping or packaging workstation by means of the operator grasping the push-bars or handles 118,118, and as can best be appreciated from FIGS. 6 and 7, the structural configuration of the left rear chassis or framework portion 20, upon which the left rear wheel 16 of the portable apparatus or system 10 is rotatably mounted, as well as the structural configuration of the right rear chassis or framework portion 24 upon which the right rear wheel 16 of the portable apparatus or system 10 is rotatably mounted, together comprise a substantially C-shaped or U-shaped chassis or framework section. Such a substantially C-shaped or U-shaped chassis or framework section effectively defines a recessed region 144 within which the operator 146 can stand while operatively steering, or maneuverably controlling, the film wrapping or packaging apparatus or system 10 as the operator 146 walks around the palletized load disposed at the palletized load film wrapping or packaging station. In particular, in view of the fact that the operator 146 is located substantially closer to the vertically oriented mast member 32, and the film roll carriage 50 movably mounted thereon, the control, steerability, and maneuverability of the apparatus or system 10 is substantially enhanced and facilitated.

Once the palletized load wrapping or packaging operation has been completed, that is, the particular palletized load has been, for example, completely wrapped within the packaging or wrapping film from the lowermost extent of the palletized load to the uppermost extent of the palletized load, the film roll carriage 50, having the roll of packaging or wrapping film 49 disposed thereon, will be disposed at its uppermost FINISHED position along the vertically oriented mast member 32. Accordingly, in order to prepare for the performance of a new film wrapping or packaging operation or procedure, to be conducted in connection with a new or subsequent palletized load, means must be provided for effectively moving the film roll carriage 50, having the roll of wrapping or packaging film 49 mounted thereon, from the noted uppermost FINISHED position back to its lowermost START position. In accordance with the unique and novel structure incorporated within the new and improved apparatus or system 10 of the present invention, two alternative means for moving the film roll carriage 50, and the roll of wrapping or packaging film 49 mounted thereon, from the noted uppermost FINISHED position back to its lowermost START position are provided.

Figure 7:
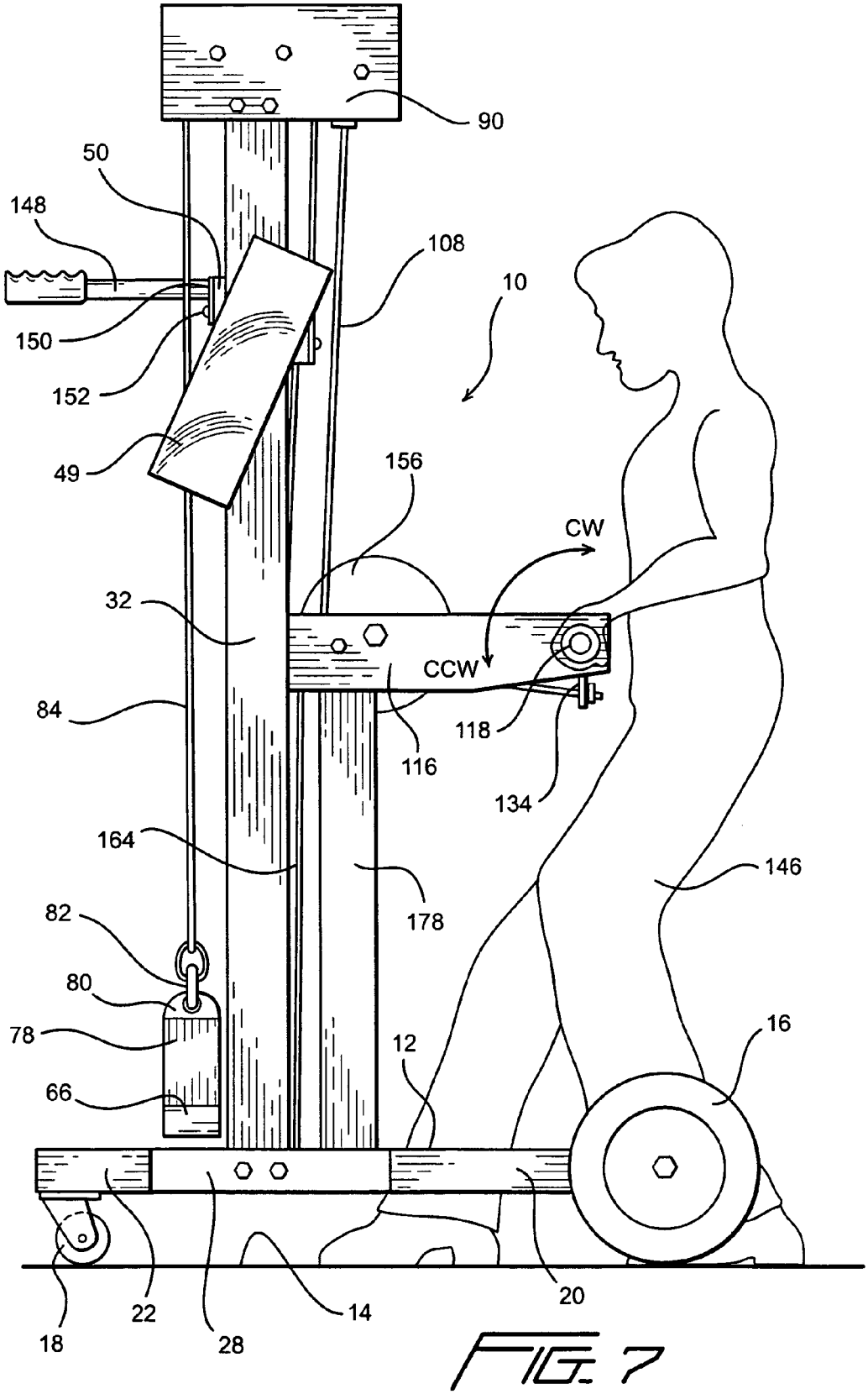
FIG. 7 is a side elevational view, of the new and improved film wrapping apparatus or system of the present invention as illustrated within FIG. 1, showing the relative position of an operator with respect to the chassis or framework when performing a film wrapping operation or cycle.

More particularly, in accordance with a first one of such means for moving the film roll carriage 50, and the roll of wrapping or packaging film 49 mounted thereon, from the noted uppermost FINISHED position back to its lowermost START position, a horizontally oriented, forwardly projecting reset handle 148 is fixedly mounted upon the forward or front side surface portion 52 of the film roll carriage 50 as disclosed, for example, within FIGS. 1 and 7. The reset handle 148 is adapted to be bolted to the forward or front side surface portion 52 of the film roll carriage 50, through means of a suitable mounting bracket 150, by means of fasteners 152 which are similar to the fasteners 96 which were used for securing the free or distal end portion of the film roll carriage lift cable 84 to the rear or back side surface 56 of the film roll carriage 50. Accordingly, when it is desired to move the film roll carriage 50, and the roll of wrapping or packaging film 49 mounted thereon, from the noted uppermost FINISHED position back to their lowermost START positions, the operator 146 grasps the reset handle 148 and moves the same vertically downwardly so as to thereby simultaneously move the film roll carriage 50, and the roll of wrapping or packaging film 49 mounted thereon, back to their lowermost START positions.

It is to be noted that in view of the aforenoted angular disposition or orientation of the holding pawl mechanism or member 98, as biased into cooperative engagement with the support block 101 by means of the tensioning spring 102, the vertically downward movement of that portion of the film roll carriage lift cable 84, that is interposed between the film roll carriage 50 and the lift cable pulley 94, always effectively causes the holding pawl member or mechanism 98 to be moved or biased away from its ENGAGED position with respect to the film roll carriage lift cable 84 and the support block 101, at which position the film roll carriage lift cable 84 is normally trapped between the holding pawl mechanism or member 98 and the support block 101, whereby the holding pawl mechanism or member 98 will be moved toward an effectively or relatively DISENGAGED position with respect to the support block 101. In this manner, that portion of the film roll carriage lift cable 84, that is interposed between the film roll carriage 50 and the lift cable pulley 94, is permitted to undergo vertically downward movement.

It is of course to be further appreciated that as the reset handle 148 is being moved vertically downwardly so as to likewise concomitantly move the film roll carriage 50, and the roll of wrapping or packaging film 49 mounted thereon, vertically downwardly to the aforenoted lowermost START positions, the vertically downward movement of the film roll carriage 50 causes that portion of the film roll carriage lift cable 84, that is attached to the negator spring members 64,66, to be moved vertically upwardly thereby once again uncoiling and operatively extending the negator spring members 64,66. Continuing further, when the film roll carriage 50 has reached its lowermost START position, further vertically downward movement of the reset handle 148 and the film roll carriage 50 is terminated, and subsequently, when the operator 146 releases the reset handle 148, the uncoiled and extended negator spring members 64,66 will once again tend to retract or recoil thereby, in turn, moving the film roll carriage lift cable 84 so as to tend to once again elevate, raise, or lift the film roll carriage 50. However, due to the aforenoted angular disposition or orientation of the holding pawl mechanism or member 98, and the biasing of the same into cooperative engagement with the support block 101 by means of the tensioning spring 102, the vertically upward movement of that portion of the film roll carriage lift cable 84, that is interposed between the film roll carriage 50 and the lift cable pulley 94, is effectively trapped such that movement of the film roll carriage lift cable 84 is effectively arrested and prevented.

Continuing further, and as can best be appreciated from FIGS. 1 and 2, a second means for moving the film roll carriage 50, and the roll of wrapping or packaging film 49 mounted thereon, from their aforenoted uppermost FINISHED positions back to their lowermost START positions, comprises a hand-crank assembly 154 which is operatively mounted upon the operator push-bar assembly housing 116. More particularly, the hand-crank assembly 154 comprises a sheave member 156 which is rotatably mounted upon the right side wall member 126 of the push-bar assembly housing 116 by means of a suitable axle or trunnion 158 whereby the sheave member 156 is rotatable around a transverse axis 160 which is disposed parallel to the transverse axis 120 characteristic of the operator push-bars or control handles 118,118. As will be disclosed more fully hereinafter, an operator control handle 162 is operatively mounted with respect to the sheave member 156 so as to be located at an eccentric position within the vicinity of the outer periphery of the sheave member 156, and accordingly, the sheave member 156 can be operatively rotated around the transverse axis 160 when the operator rotates the control handle 162 of the sheave member 156 around the transverse axis 160. In addition to, or in conjunction with, the hand crank assembly 154, a substantially vertically oriented film roll carriage reset cable 164 has a first end portion 166 fixedly connected to a right side surface portion of the film roll carriage 50 by means of a suitable mounting bracket 165 and fasteners 167, while a second end portion 168 is fixedly connected to the rotary sheave member 156. It is also seen that a guide pulley 170 is mounted upon the right side intermediate framework or chassis portion 30 so as to be rotatable around a transverse axis 172 thereof, and in this manner, an intermediate portion of the film roll carriage reset cable 164 is able to be routed around the guide pulley 170 so as to effectively change the directional orientation of the film roll carriage reset cable 164 as the same extends from or between the right side surface portion of the film roll carriage 50 and the rotatable sheave member 156.

It may therefore be appreciated that when a film wrapping or packaging operation that has been performed upon or in connection with a palletized load has been completed and it is therefore desired to move the film roll carriage 50, and the roll of wrapping or packaging film 49 mounted thereon, from their aforenoted uppermost FINISHED positions back to their lowermost START positions, the operator 146 grasps the control handle 162 and rotates the sheave member 156 in the clockwise direction CW so as to effectively coil or accumulate the film roll carriage reset cable 164 upon the sheave member 156. As a result of such an operation, and as a result of the provision of the guide pulley 170 which effectively changes the directional orientation of the film roll carriage reset cable 164, vertically upward movement of that section of the film roll carriage reset cable 164 interposed between the guide pulley 170 and the sheave member 156 will cause a simultaneous vertically downward movement of that section of the film roll carriage reset cable 164 interposed between the guide pulley 170 and the film roll carriage 50.

Accordingly, as the film roll carriage reset cable 164 is continuously accumulated upon the sheave member 156, the film roll carriage 50, and the roll of wrapping or packaging film 49 mounted thereon, will eventually be lowered back to their lowermost START positions. It is of course to be appreciated, as was described in connection with the manual operation or manipulation of the reset handle 148 and its operative connection to the film roll carriage 50, that as the film roll carriage 50 begins to be manually lowered toward its lowermost START position, the film roll carriage lift cable 84 will bias the holding pawl mechanism or member 98 away from its cooperative support block 101 so as to in fact permit that portion of the film roll carriage lift cable 84, interposed between the holding pawl mechanism or member 98 and the support block 101, to actually freely pass or move between the holding pawl mechanism or member 98 and the support block 101.

In addition, it is likewise to be appreciated that as a result of the vertically downward movement of the film roll carriage 50, the operative connection of the film roll carriage 50 to the pair of negator spring members 64,66, through means of the film roll carriage lift cable 84, will cause the negator spring members 64,66 to be uncoiled and extended in preparation for a new or subsequent operative cycle wherein such uncoiled and extended negator spring members 64,66 will tend to raise, lift, or elevate the film roll carriage 50, and the roll of wrapping or packaging film 49 mounted thereon, from their lowermost START positions toward their uppermost FINISH positions in connection with the film wrapping or packaging of a new or subsequent palletized load. It is to be noted further that, in view of the fact that the rotary sheave member 156 is always connected to the film roll carriage 50 through means of the film roll carriage reset cable 164, then when the film roll carriage 50 is lifted or elevated during its rise from its lowermost START position toward its uppermost FINISH position, the film roll carriage reset cable 164 will cause the rotary sheave member 156 to effectively rotatably freewheel as the film roll carriage reset cable 164 is unwound from the rotary sheave member 156. Since the operator control handle 162, operatively disposed upon the sheave member 156, normally projects or extends transversely outwardly from the sheave member 156 as can be readily appreciated from FIG. 2, the control handle 162 might possibly present a safety hazard as the same moves in a rotary path as the rotary sheave member 156 freewheels during the aforenoted rise of film roll carriage 50.

Figure 8:
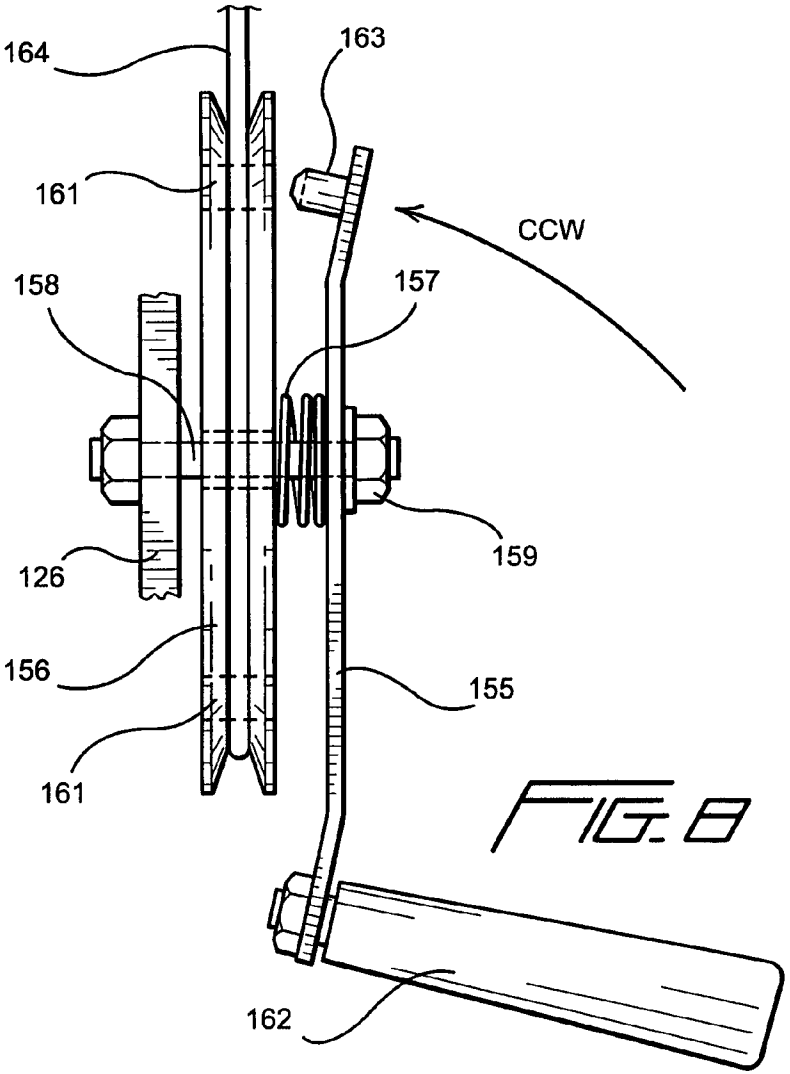
FIG. 8 is a partial rear elevational view showing the rotatable mounting of the rotary sheave member upon the push-bar assembly housing and the mounting of the operator control handle upon the rotary sheave member such that the operator control handle can be moved between engaged and disengaged states with respect to the rotary sheave member.

Therefore, in accordance with a first structural embodiment, the operator control handle 162 may be operatively mounted upon the sheave member 156 by means of a relatively simple clutch mechanism whereby the control handle 162 can be moved between a first engaged position with respect to the rotary sheave member 156 such that the control handle 162 can in fact cause rotation of the rotary sheave member 156, and a second disengaged position with respect to the rotary sheave member 156 so that the rotary sheave member 156 can rotate independently of the control handle 162. More particularly, as can best be appreciated from FIG. 8, the operator control handle 162 is mounted upon a first end portion of a mounting bracket 155, and a substantially central portion of the mounting bracket 155 is mounted upon the axle 158 upon which the rotary sheave member 156 is rotatably mounted. The mounting bracket 155 is axially spaced from the rotary sheave member 156, and a coil spring member 157, disposed around the axle 158, is interposed between the rotary sheave member 156 and the mounting bracket 155 so as to normally bias the mounting bracket 155 away from the rotary sheave member 156. A lock nut 159 secures the mounting bracket 155 upon the axle 158, however, due to the fact that the mounting bracket 155 is mounted upon the axle 158 in a freely rotatable manner, and furthermore, due to the biasing of the mounting bracket 155 by means of the coil spring member 157, the mounting bracket 155 is tiltable to a predetermined degree with respect to the rotary sheave member 156. The rotary sheave member 156 has a plurality of apertures 161 defined within substantially peripheral edge portions thereof, and the apertures 161 are arranged within a circular array at positions spaced 900 apart. A second opposite end portion of the mounting bracket 155 has an engagement pin 163 mounted thereon, and therefore, it can be appreciated that when the operator control handle 162 and the mounting bracket 159 are tilted slightly in the counterclockwise direction CCW so as to operatively insert the engagement pin 163 into one of the apertures 161, the rotary sheave member 156 can be rotated as a result of rotation of the operator control handle 162. Alternatively, when the operator control handle 162 and the mounting bracket 155 are no longer tilted whereby the operator control handle 162 and the mounting bracket 155 will be disposed at their respective positions as illustrated within FIG. 8, whereby the engagement pin 163 will effectively be removed from its previously associated aperture 161, under the bias of the coil spring member 157 acting upon the mounting bracket 155, the operator control handle 162 and the mounting bracket 155 will simply hang vertically downwardly in a dependent manner and the rotary sheave member 156 will then be able to rotate independently of the operator control handle 162.

It is also to be noted that in accordance with a second alternative structural embodiment, the control handle 162 can be mounted upon the rotary sheave member 156 by means of a collapsible connection. In this manner, when the control handle 162 is disposed at its operative position in order to achieve the film roll carriage reset operation, the control handle 162 will project or extend laterally outwardly as disclosed, for example, within FIGS. 2 and 8, however, when the control handle 162 is disposed at its inoperative position, such as when a film roll carriage reset operation is not being performed, then in lieu of the control handle 162 projecting laterally outwardly from the rotary sheave member 156 as disclosed in FIGS. 2 and 8, the control handle 162 can be folded downwardly so as to achieve a vertically downward orientation. It is to be noted further that while two alternative means or systems, comprising, for example, the reset handle 148 and the hand-crank assembly 154, have been disclosed for operatively resetting or moving the film roll carriage between its uppermost FINISH position and its lowermost START position, both of the two alternative means or systems, comprising the reset handle 148 and the hand-crank assembly 154, need not necessarily be used together, but to the contrary, either one of such means or systems may be used independently of the other means or system. It is noted still further, however, that should both reset means or systems be incorporated upon the apparatus for alternative use as may be desired, when the reset operation is being conducted by using the reset handle 148, downward movement of the film roll carriage 50 may cause, in effect, a slackening of the reset cable 164 as connected to the rotary sheave member 156. Accordingly, to effectively prevent such slackening of the reset cable 164 from occurring, it is noted that a suitable spring member or retractor mechanism, not shown, may be operatively interconnected between the rotary sheave member 156 and the push-bar assembly housing 116.

Continuing further, several other structural features characteristic of the new and improved film wrapping or packaging apparatus or system 10 of the present invention will now be disclosed and described. For example, it is to be additionally appreciated that in conjunction with the implementation of the various film wrapping or packaging operations, procedures, or cycles, that if the particular roll of packaging or wrapping film 49 that is disposed upon the film roll carriage 50 should become depleted, whereby such existing roll of packaging or wrapping film 49 needs to be removed from the film roll carriage 50 and a new roll of packaging or wrapping film 49 needs to be installed upon the film roll carriage 50, the apparatus or system 10 is provided with means for holding a spare roll of packaging or wrapping film. As can best be seen in FIG. 6, a vertically upwardly projecting tubular stanchion 174 is fixedly mounted upon a horizontally disposed support plate 176 which is integrally connected between the right rear chassis or frame-work portion 24 upon which the right rear wheel 16 is rotatably mounted, and the right front chassis or framework portion 26 upon which the right front caster wheel 18 is pivotally mounted. The upstanding stanchion 174 therefore effectively serves as a support or holder upon which the core member of the spare roll of packaging or wrapping film 49 can be mounted.

Still further, as can best be appreciated from FIGS. 1,4,6, and 7, a vertically oriented post or standard 178 is disposed substantially directly behind the vertically oriented mast member 32, and it is seen that the lower end portion of the vertically oriented post or standard 178 is interposed between and fixedly mounted upon the left and right intermediate chassis or framework portions 28,30 by means of suitable fasteners, not shown. The upper end portion of the vertically oriented post or standard 178 is likewise adapted to be fixedly connected to the push-bar assembly housing 116 by means of suitable fasteners, not shown, and in this manner, the push-bar assembly housing 116 is mounted upon the apparatus or system 10 in a stabilized manner as a result of its additional operative connection to the vertically oriented mast member 32 as has been previously discussed in connection with the structure disclosed in FIG. 3.

With reference again being made to FIG. 3, and with additional reference being made to FIG. 9, an additional structural feature characteristic of the new and improved film wrapping apparatus or system 10 of the present invention will now be described. While the vertically oriented mast member 32 may in fact comprise a single or one-piece vertically upstanding structure, the vertically oriented mast member may alternatively be fabricated as a mated arrangement of two vertically oriented mast sections. More particularly, the pair of vertically oriented mast sections comprises an upper mast section 32U and a lower mast section 32L, with the upper mast section 32U adapted to be fixedly but removably mounted atop the lower mast section 32L. It is to be appreciated that the structure of each one of the upper and lower mast sections 32U, 32L is substantially the same as that of the single mast member 32 as disclosed, for example, within FIGS. 1–4, 6, and 7, in that the cross-sectional configuration of each one of the upper and lower mast members 32U, 32L is the same as the cross-sectional configuration of the single mast member 32 as disclosed within FIG. 3. Accordingly, it is to be appreciated that each one the upper and lower mast members 32U, 32L comprises four side surfaces, and in particular, the side surfaces 40U, 40L are disclosed within FIG. 9.

Still further, it is to be appreciated that the each one of the side surfaces 40U, 40L of the upper and lower mast members 32U, 32L has a vertically oriented mortise-shaped recess 48U, 48L respectively defined therein, and that the tenon 142, which was formed upon the free or distal end portion of the side wall 126 of the push-bar assembly housing 116, is adapted to be matingly inserted within both of the upper and lower mortise-shaped recesses 48U, 48L at an elevational position which permits the tenon 42 to effectively overlap the interface 180 defined between the lower end portion of the upper mast member 32U and the upper end portion of the lower mast member 32L. A pair of transversely extending suitable bolt fasteners, or the like, 182U, 182L are inserted through the tenon 42 portion of the side wall 126 of the push-bar assembly 116 so as to mate with suitable apertures or bores respectively formed within the mortise-shaped recessed regions 48U, 48L respectively formed within the lower end portion of the upper mast member 32U and within the upper end portion of the lower mast member 32L, and in this manner, not only is the push-bar assembly 116 fixedly mounted upon the upper and lower mast members 32U, 32L, but in addition, the upper and lower mast members 32U, 32L are fixedly secured together. Still further, in order to initially mate the upper and lower mast members 32U, 32L together, and prior to their actual fixation by means of the tenon 142 and the bolt fasteners 182U, 182L, the lower mast member 32L is provided with a vertically oriented, centrally located bore 184, as can best be seen in FIG. 3, and the upper mast member 32U is provided with a vertically oriented, dependent rod member, not shown for clarity purposes, which is adapted to be inserted into the bore 184.

Figure 9:
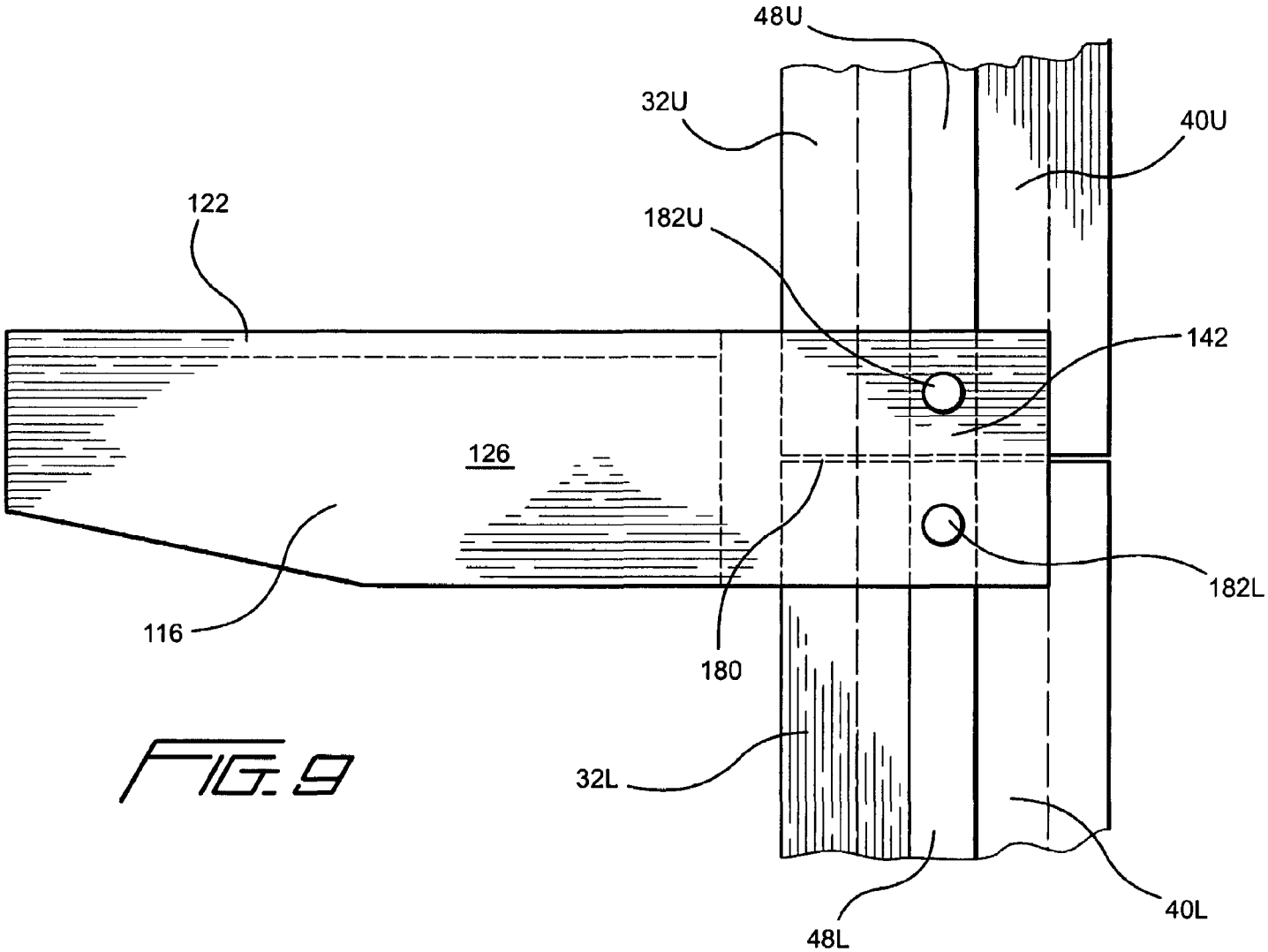
FIG. 9 is a partial, right side elevational view showing a further embodiment of a vertically oriented mast member, comprising an upper mast section and a lower mast section, and the attachment of the push-bar assembly housing upon the vertically oriented mast member, and at the junction of the upper and lower mast sections, so as to securely yet removably attach the upper and lower mast sections together.

Accordingly, when the mast members 32U, 32L are initially assembled together, for example, the dependent rod member, not shown, of the upper mast member 32U will be inserted into the bore 184 defined within the lower mast member 32L whereby the mast members 32U, 32L will be disposed within their vertically stacked array as illustrated within FIG. 9. It is of course to be further appreciated that since the upper and lower mast members 32U, 32L are, at this point in time, only connected together by means of the noted dependent rod member, not shown, of the upper mast member 32U having been inserted within the bore 184 defined within the lower mast member 32L, the upper mast member 32U is effectively permitted to rotate around a vertical axis with respect to the lower mast member 32L. It is critically important, however, that such relative rotation does not in fact occur because the mortise-shaped recesses 42, 44, 46, defined within each of the other side surfaces 34, 36, 38 of each one of the upper and lower mast members 32U, 32L, would not be vertically aligned with respect to each other so as to permit the film roll carriage 50 to move smoothly along both the upper and lower mast members 32U, 32L and in particular, to smoothly traverse the interface 180 defined between the upper and lower mast members 32U, 32L. Therefore, as a result of the upper and lower mast members 32U, 32L being fixedly secured together by means of the tenon 142 and the bolt fasteners 182U, 182L, such relative rotation between the upper and lower mast members 32U, 32L will effectively be prevented.

It is to be further that the objective of providing the vertically oriented mast member as an assembly comprising the upper and lower mast members 32U, 32L is that such an assembly enables the composite vertically oriented mast member to effectively be disassembled when, for example, it is desired to transport the new and improved apparatus or system 10, and wherein further, the apparatus or system 10 must pass through a doorway wherein the vertical or height clearance of the doorway is less than the overall vertical height dimension of composite mast member. Accordingly, in order to achieve such disassembly of the mated mast members 32U, 32L, the upper bolt fastener 182U is removed or disengaged from its fixed attachment state with respect to the upper mast member 32U, and subsequently, the upper mast member 32U is effectively disengaged from the lower mast member 32L as a result of disengaging the dependent rod member, not shown, from the central bore 184 defined within the lower mast member 32L. The upper mast member 32U may then be disposed and maintained at a horizontal orientation so as to permit the new and improved apparatus or system 10 to in fact be transported as desired. It is lastly noted in connection with such disassembly of the mast members 32U, 32L that in order to effectively move the disengaged upper mast member 32U to its temporary horizontal orientation, the negator spring members 64,66 may need to be uncoiled and extended a limited amount. It is of course to be further appreciated that re-verse assembly procedures may be implemented so as to once again re-assemble the upper mast member 32U atop the lower mast member 32L once the new and improved apparatus or system 10 has in fact been transported to its desired location.

It is lastly noted in connection with the performance of the film wrapping operations that while it is usually preferred that the wrapping mode proceed upwardly from the bottom of the palletized load or load to the top of the palletized load or product whereby successively applied layers of the film wrapping or packaging are then disposed upon the palletized load or product in an overlapped mode similar to the disposition of shingles upon a building roof so as to protect the load or product from exposure and weather conditions, it is sometimes desired to wrap the palletized load or product in accordance with a wrapping mode which proceeds downwardly from the top of the palletized load or product to the bottom of the palletized load or product. In accordance with the principles and teachings of the present invention, and as afforded by means of the unique structural arrangement of the various components of the new and improved film wrapping apparatus or system 10 of the present invention, such an alternative mode of operation is readily able to be achieved without the need for altering, repositioning, or reversing any of the structural components comprising the new and improved film wrapping apparatus or system 10 of the present invention. More particularly, it is to be readily appreciated that in order to perform such an effectively reversed film wrapping operation or mode, that is, when it is desired to wrap the palletized load or product in accordance with a wrapping mode which proceeds downwardly from the top of the palletized load or product to the bottom of the palletized load or product, the operator 146 will rotate the push-bar handles 118, 118 so as to cause the holding pawl mechanism or member 98 to be moved from its ENGAGED position with respect to the film roll carriage lift cable 84 to its DISENGAGED position with respect to the film roll carriage lift cable 84. Accordingly, the film roll carriage 50 will move upwardly under the influence of the negator spring members 64, 66 so as to eventually be disposed at its uppermost position which, for the purposes of this particular top-to-bottom film wrapping mode or operation, is now to be considered the START position. After the film roll carriage 50 has attained its uppermost START position, the operator 146 no longer rotatably actuates the push-bar handles 118, 118 such that the holding pawl mechanism or member 98 can once again be disposed in engaged contact with the film roll carriage lift cable 84. Subsequently, when the film wrapping operation is to be performed, the operator 146 can, for example, grasp the left side push-bar handle 118 so as to steer the apparatus or system 10 around the workstation at which the palletized load is located, and simultaneously therewith, the operator can grasp and rotate the reset handle 162 disposed upon the rotary sheave member 156 in the clockwise direction CW. This simultaneous mode of operation is permitted or facilitated as a result of the aforenoted disposition of the operator 146 within the recessed portion 144 defined between the rear wheels 16 of the apparatus or system 10.

Consequently, as a result of the clockwise rotation of the rotary sheave member 156, the reset cable 164 will be accumulated upon the rotary sheave member 156, in a manner similar to the previously described resetting of the film roll carriage 50 from its uppermost FINISH position to its lowermost START position during the bottom-to-top load wrapping mode of operation, whereby the film roll carriage 50 will in fact be moved from its uppermost START position to its lowermost FINISH position. It is to be noted that, in a manner similar to the previously resetting operation for the film roll carriage 50, while the film roll carriage 50 is being moved vertically downwardly, that portion of the film roll carriage lift cable 84 which passes by the holding pawl mechanism or member 98 effectively causes the holding pawl mechanism or member 98 to be deflected away from the cooperative support block 101 so as to in fact permit that portion of the film roll carriage lift cable 84 to pass by the holding pawl mechanism or member 98. Upon cessation of the rotary operation of the rotary sheave member 156 and the downward movement of the film roll carriage 50, the holding pawl mechanism or member 98 can again be disposed at its ENGAGED position with respect to the film roll carriage lift cable 84 so as to effectively arrest the movement of the film roll carriage 50 at any particular elevational level. When a new wrapping operation is to be performed, the push-bar handles 118, 118 may be actuated so as to release the holding pawl mechanism 98 from its ENGAGED position with respect to the film roll carriage lift cable 84 whereby the negator spring members 64,66 will again elevate the film roll carriage 50 from its lowermost FINISH position to its uppermost START position.

Thus, it may be seen that in accordance with the principles and teachings of the present invention, a new and improved film wrapping apparatus or system has been developed which is extremely simple in structure, wherein the same is truly portable and transportable, and wherein further, the apparatus or system is readily capable of performing various different wrapping modes upon a palletized load or product, and in both upwardly and downwardly proceeding directions. It is to be especially appreciated that as a result of the provision of the negator spring system, and the holding pawl mechanism repetitively engaged with the film roll carriage lift cable, the ascent or descent of the film roll carriage can be reliably achieved in a safely controlled manner without the operational drawbacks of conventional counterweights. In addition, two alternative reset mechanisms may also be incorporated within the apparatus so as to effectively move the film roll carriage between its START and FINISH positions during either one of its wrapping operation modes.

Obviously, many variations and modifications of the present invention are possible in light of the above teachings. For example, in lieu of the film roll carriage lift cable, a film roll carriage lift strap, belt, or similar operative connection member, can be utilized, and similarly, of course, with respect to the release cable and the reset cable. Still further, it is certainly to be appreciated that in order to facilitate the slidable movement of the film roll carriage along the vertically oriented mast member, the interengaged mortise and tenon parts thereof can be fabricated from a suitable material, such as, for example, NYLON or the like. Lastly, it is also noted that the size and position of the rotary sheave member can be varied so as to correspondingly alter the moment arm or mechanical advantage that the operator can impress upon such operative components when using the same in conjunction with the film wrapping or packaging operations. It is therefore to be understood that within the scope of the appended claims, the present invention may be practiced otherwise than as specifically described herein.

What is claimed as new and desired to be protected by Letters Patent of the United States of America, is:

1. Portable apparatus adapted to be moved along a circular locus around an article disposed at a wrapping station so as to be capable of wrapping the article in wrapping film, comprising:

a chassis framework;

a plurality of wheels mounted upon said chassis framework so as to enable said portable apparatus to be moved around a wrapping station at which an article is to be wrapped;

a vertically oriented mast assembly mounted upon said chassis framework;

a film roll carriage vertically movable upon said vertically oriented mast assembly between START and FINISH positions during a film wrapping operation performed upon an article at the wrapping station;

a roll of wrapping film mounted upon said film roll carriage;

connection means operatively connected at a first end portion thereof to said film roll carriage, and operatively connected at a second end portion thereof to said chassis framework, for biasing said film roll carriage in a vertically upward direction; and control means mounted upon said vertically oriented mast assembly for movement between ENGAGED and DISENGAGED positions with respect to said connection means so as to operatively control the vertical movement of said film roll carriage along said vertically oriented mast assembly between said START and FINISH positions by permitting said film roll carriage to move in said vertically upward direction, under the biasing influence of said connection means, as a result of said control means being disposed at said DISENGAGED position with respect to said connection means, and by preventing movement of said film roll carriage in said vertically upward direction, under the biasing influence of said connection means, as a result of said control means being disposed at said ENGAGED position with respect to said connection means.

2. The apparatus as set forth in claim 1, wherein said connection means comprises:

at least one spring member having a first end portion operatively connected to said chassis framework; and a lift member, selected from the group comprising a lift cable, a lift strap, and a lift belt, having a first end portion operatively connected to said film roll carriage and a second end portion thereof operatively connected to a second end portion of said at least one spring member.

3. The apparatus as set forth in claim 2, wherein:

said at least one spring member comprises a pair of negator spring members which are normally disposed in a CONTRACTED, COILED state but which can be moved to an EXTENDED UNCOILED state so as to impart a biasing force upon said film roll carriage, through means of said lift member, so as to tend to cause said film roll carriage to undergo vertically upward movement along said vertically oriented mast assembly.

4. The apparatus as set forth in claim 2, wherein:

said vertically oriented mast assembly comprises a vertically oriented mast member, and at least one mounting plate fixedly mounted upon an upper end portion of said vertically oriented mast member;

said control means comprises a holding pawl pivotally mounted upon said at least one mounting plate between said ENGAGED and DISENGAGED positions; and a tensioning spring has a first end portion thereof mounted upon said at least one mounting plate, and a second end portion thereof connected to said holding pawl so as to normally bias said holding pawl toward said ENGAGED position with respect to said lift member.

5. The apparatus as set forth in claim 4, further comprising:

push-bar assembly means mounted upon said vertically oriented mast assembly for enabling an operator to operatively steer said apparatus around the wrapping station; and release means operatively connected at a first end portion thereof to said push-bar assembly means, and operatively connected at a second end portion thereof to said holding pawl, so as to control said disposition of said holding pawl, in cooperation with said tensioning spring, between said ENGAGED and DISENGAGED positions with respect to said lift member.

6. The apparatus as set forth in claim 5, wherein:

said push-bar assembly means comprises a mounting bracket mounted upon said vertically oriented mast member, a pair of handles integrally connected together, extending outwardly in opposite directions from said mounting bracket, and pivotally mounted upon said mounting bracket; and an actuating lever fixedly mounted upon said integrally connected pair of handles and operatively connected to said release means whereupon pivotal movement of said integrally connected pair of handles, and said actuating lever, said release means can control said disposition of said holding pawl between said ENGAGED and DISENGAGED positions with respect to said lift member.

7. The apparatus as set forth in claim 4, further comprising:

push-bar assembly means mounted upon said chassis framework for enabling an operator to operatively steer said apparatus around the wrapping station; and release means operatively connected at a first end portion thereof to said push-bar assembly means, and operatively connected at a second end portion thereof to said holding pawl, so as to control said disposition of said holding pawl, in cooperation with said tensioning spring, between said ENGAGED and DISENGAGED positions with respect to said lift member.

8. The apparatus as set forth in claim 7, wherein:

said push-bar assembly means comprises a mounting bracket mounted upon said vertically oriented mast member, a pair of handles integrally connected together, extending outwardly in opposite directions from said mounting bracket, and pivotally mounted upon said mounting bracket; and an actuating lever fixedly mounted upon said integrally connected pair of handles and operatively connected to said release means whereupon pivotal movement of said integrally connected pair of handles, and said actuating lever, said release means can control said disposition of said holding pawl between said ENGAGED and DISENGAGED positions with respect to said lift member.

9. The apparatus as set forth in claim 2, wherein:

said film roll carriage is vertically movable along said vertically oriented mast assembly between a lower START position and an upper FINISH position, as a result of said at least one spring member being moved from said an EXTENDED state back to a CONTRACTED state, such that the wrap-ping operation can proceed vertically upwardly from, the bot-tom of the article to the top of the article; and reset means are mounted upon said apparatus for resetting the position of said film roll carriage back to said lower START position, from said upper FINISH position, upon completion of a film wrapping operation, so as to again cause said at least one spring member to be moved from said CONTRACTED state to said EXTENDED state in preparation for a new film wrapping operation.

10. The apparatus as set forth in 9, wherein:

said reset means comprises a reset handle fixedly mounted upon said film roll carriage for enabling the operator to move said film roll carriage vertically downwardly from said upper FINISH position to said lower START position.

11. The apparatus as set forth in 9, wherein said reset means comprises:

a reset cable fixedly connected at one end thereof to said film roll carriage; and a rotary sheave member, upon which a second end portion of said reset cable is connected, for coiling said reset cable so as to move said film roll carriage vertically downwardly from said upper FINISH position to said lower START position.

12. The apparatus as set forth in claim 1, wherein:

said film roll carriage is vertically movable along said vertically oriented mast assembly between an upper START position and a lower FINISH position whereby the wrapping operation can proceed vertically downwardly from the top of the article to the bottom of the article; and manual means are mounted upon said apparatus for moving said film roll carriage from said upper START position to said lower FINISH position.

13. The apparatus as set forth in claim 4, wherein:

said vertically oriented mast member comprises a pair of vertically stacked, separable mast members which can be separated from each other so as to reduce the height dimension of said vertically oriented mast member in order to facilitate transportation of said apparatus from one location to another.

14. The apparatus as set forth in claim 1, wherein:

said chassis framework has a substantially C-shaped rear section, upon which rear wheels are mounted, so as to define a recessed region within which an operator may stand so as to optimally control said apparatus during a film wrapping operation.

15. A method of wrapping an article, disposed at a wrapping station, within wrapping film, by means of portable apparatus which is adapted to be moved along a circular locus around the article disposed at the wrapping station, comprising the steps of:

providing a chassis framework upon which a plurality of wheels are mounted so as to enable said portable apparatus to be moved around a wrapping station at which an article is to be wrapped;

mounting a vertically oriented mast assembly upon said chassis framework;

mounting a film roll carriage, having a roll of wrapping film mounted thereon, upon said vertically oriented mast assembly such that said film roll carriage is vertically movable between START and FINISH positions during a film wrapping operation performed upon the article disposed at the wrapping station;

operatively connecting a first end portion of a connection means to said film roll carriage, and operatively connecting a second end portion of said connection means to said chassis framework, for biasing said film roll carriage in a vertically upward direction;

mounting control means upon said vertically oriented mast assembly for movement between ENGAGED and DISENGAGED positions with respect to said connection means; and operatively controlling the vertical movement of said film roll carriage along said vertically oriented mast assembly between said START and FINISH positions by disposing said control means at said DISENGAGED position with respect to said connection means so as to permit said film roll carriage to be moved in said vertically upward direction under the biasing influence of said connection means, and by disposing said control means at said ENGAGED position with respect to said connection means so as to prevent said film roll carriage from undergoing movement in said vertically upward direction under the biasing influence of said connection means.

16. The method as set forth in claim 15, further comprising the steps of:

providing said connection means as at least one spring member having a first end portion operatively connected to said chassis framework, and a lift member, selected from the group comprising a lift cable, a lift strap, and a lift belt, having a first end portion operatively connected to said film roll carriage and a second end portion operatively connected to a second end portion of said at least one spring member;

moving said film roll carriage to a vertically lower START position so as to cause said at least one spring member to be operatively moved from a normally CONTRACTED state to an operatively EXTENDED state; and moving said control means from said ENGAGED position with respect to said lift member to said DISENGAGED position with respect to said lift member so as to permit said at least one spring member to vertically move said film roll carriage from said lower START position toward an upper FINISH position as said at least one spring member returns from said operatively EXTENDED state toward said normally CONTRACTED state whereby wrapping of the article can proceed in accordance with a bottom-to-top mode of operation.

17. The method as set forth in claim 16, further comprising the step of:

providing said at least one spring member as a pair of negator spring members.

18. The method as set forth in claim 16, further comprising the step of:

manually operating reset means, operatively connected to said film roll carriage, for moving said film roll carriage from said upper FINISH position back to said lower START position, upon completion of the article wrapping operation, in preparation for a new article wrapping operation.

19. The method as set forth in claim 18, further comprising the step of:

mounting a reset handle upon said film roll carriage; and manually moving said film roll carriage vertically downwardly from said upper FINISH position to said lower START position by pulling downwardly upon said reset handle.

20. The method as set forth in 18, further comprising the steps of:

connecting a first end portion of a reset cable ted to said film roll carriage, and connecting a second end portion of said reset cable to a rotary sheave member; and rotating said rotary sheave member for coiling said reset cable thereon so as to move said film roll carriage vertically downwardly from said upper FINISH position to said lower START position.

21. The method as set forth in claim 15, further comprising the steps of:

providing said connection means as at least one spring member having a first end portion operatively connected to said chassis framework, and a lift member, selected from the group comprising a lift cable, a lift strap, and a lift belt, having a first end portion operatively connected to said film roll carriage and a second end portion operatively connected to a second end portion of said at least one spring member;

moving said control means from said ENGAGED position with respect to said lift member to said DISENGAGED position with respect to said lift member so as to permit said at least one spring member to vertically move said film roll carriage to an upper START position as said at least one spring member moves from an operatively EXTENDED state back toward a normally CONTRACTED state whereby wrapping of the article can proceed in accordance with a top-to-bottom mode of operation;

manually moving said film roll carriage from said upper START position toward said lower FINISH position so as to cause said control means to be moved from said ENGAGED position with respect to said lift member to said DISENGAGED position with respect to said lift member whereby said film roll carriage will be permitted to move toward said lower FINISH position, said at least one spring member simultaneously being moved from said normally CONTRACTED state to said EXTENDED state; and terminating manual movement of said film roll carriage toward said lower FINISH position so as to permit said control means to be moved back to said ENGAGED position with respect to said lift member so as to maintain said film roll carriage at said lower FINISH position.

22. The method as set forth in claim 21, further comprising the step of:

providing said at least one spring member as a pair of negator spring members.

* * * * *